US010213634B1

(12) United States Patent
Maldonado

(10) Patent No.: US 10,213,634 B1
(45) Date of Patent: Feb. 26, 2019

(54) FIRE BARRIER BLANKET

(71) Applicant: Donald J. Maldonado, Whittier, CA (US)

(72) Inventor: Donald J. Maldonado, Whittier, CA (US)

( * ) Notice: Subject to any disclaimer, the term of this patent is extended or adjusted under 35 U.S.C. 154(b) by 0 days.

(21) Appl. No.: 14/545,543

(22) Filed: May 20, 2015

(51) Int. Cl.
*A62C 3/02* (2006.01)
*E04B 1/94* (2006.01)
*A62C 2/06* (2006.01)

(52) U.S. Cl.
CPC ..... *A62C 3/0214* (2013.01); *A62C 2/06* (2013.01); *A62C 3/0257* (2013.01); *E04B 1/94* (2013.01)

(58) Field of Classification Search
CPC ..... A62C 3/0214; A62C 2/06; A62C 3/0257; E04B 1/94
USPC ..... 52/3, 4
See application file for complete search history.

(56) References Cited

U.S. PATENT DOCUMENTS 1,871,101 A * 8/1932 Waltz ..... B63B 19/24 135/115
2,365,127 A * 12/1944 Wagner ..... A62C 2/10 160/120
3,715,843 A * 2/1973 Ballinger ..... E04B 1/945 52/3
3,766,958 A * 10/1973 Mitchell ..... A62C 2/10 160/1
4,311,199 A 1/1982 Elias
4,624,320 A 11/1986 Romaine
4,756,945 A 7/1988 Gibb
4,858,395 A * 8/1989 McQuirk ..... E04B 1/94 52/3
5,076,969 A 12/1991 Fox
5,397,509 A 3/1995 Kostrzecha
5,423,150 A 6/1995 Hitchcock
5,505,265 A 4/1996 O'Neil
5,608,992 A * 3/1997 Floyd ..... E04B 1/94 135/115
5,759,659 A 6/1998 Sanocki et al.
5,791,090 A * 8/1998 Gitlin ..... E04H 9/14 52/4
5,829,200 A * 11/1998 Jones ..... A62C 2/10 52/3
5,860,251 A * 1/1999 Gleich ..... A62C 3/0257 52/2.18
5,875,598 A 3/1999 Batten et al.
6,125,941 A * 10/2000 Lokken ..... A62C 3/0228 169/48
6,319,573 B1 11/2001 Lokken
6,696,374 B2 2/2004 Bridgeman et al.
6,810,626 B2 * 11/2004 Meyer ..... A62C 3/0257 52/1

(Continued)

*Primary Examiner* — Brian E Glessner
*Assistant Examiner* — Adam G Barlow
(74) *Attorney, Agent, or Firm* — Gordon Rees Scully Mansukhani LLP; Reid E. Dammann; Kathryn K. Hull

(57) ABSTRACT

A fire resistant system comprising a flexible blanket sized to be deployable on or over an edifice, or part thereof, the blanket being flame retardant and heat resistant, the blanket consisting of aromatic polyamide (aramid) fibers defining a knit yarn fabric, the blanket fabric defining distributed vent openings of small size to freely pass air from one side of the blanket to the other, and away from elongated edifice associated objects such as hot embers, the blanket having edges configured to be pulled for distributing the blanket over the edifice.

16 Claims, 2 Drawing Sheets

(56) References Cited

U.S. PATENT DOCUMENTS

| | | | | |
|---|---|---|---|---|
| 6,820,373 | B1 * | 11/2004 | Bundy, Jr. | E04H 9/14 52/1 |
| 7,578,100 | B2 * | 8/2009 | Sicurella | E04H 9/14 52/4 |
| 7,670,663 | B2 * | 3/2010 | Poulakis | A44B 18/0023 139/384 R |
| 8,007,888 | B2 | 8/2011 | Sangouard et al. | |
| 8,297,371 | B1 * | 10/2012 | Musser, Jr. | A62C 2/10 169/43 |
| 8,851,198 | B2 * | 10/2014 | Burnham | A62C 2/06 169/48 |
| 8,869,813 | B2 * | 10/2014 | Kanayanna | D03D 1/00 135/115 |
| 9,598,860 | B2 * | 3/2017 | Davis | E04B 1/94 |
| 9,630,031 | B2 * | 4/2017 | Thatcher | A62B 17/003 |
| 2008/0057807 | A1 * | 3/2008 | Tutterow | A41D 31/0022 442/1 |
| 2010/0294520 | A1 * | 11/2010 | Aguirre | A62C 3/0257 169/45 |
| 2012/0144794 | A1 * | 6/2012 | Ke | D02G 1/02 57/90 |
| 2017/0021208 | A1 * | 1/2017 | Dor-El | D04B 21/14 |
| 2017/0100614 | A1 * | 4/2017 | Ingersoll | A62C 3/0257 |
| 2017/0167058 | A1 * | 6/2017 | Tutterow | A41D 31/0022 |

* cited by examiner

FIRE BARRIER BLANKET

This application claims priority from provisional application Ser. No. 61/997,399, filed May 29, 2014.

BACKGROUND OF THE INVENTION

This invention relates generally to blocking fires from spreading on buildings, and more particularly concerns use of blankets spread over buildings to suppress embers, flames and spreading of fires.

There is need, particularly in residential areas, for simple, effective, easy to use apparatus to suppress or prevent spreading of fires as on roofs and at building sites.

Further there is need for fire suppression barrier devices such as blankets, specifically constructed and sized for these purposes.

SUMMARY OF THE INVENTION

It is a major object of the invention to provide a fire barrier that includes:

a) providing and deploying a flexible blanket on or over an edifice, or part thereof, b) the blanket being flame retardant and heat resistant, c) the blanket consisting of aromatic polyamide (aramid) fibers defining a knit yarn fabric, d) the blanket provided to define distributed vent openings of small size to freely pass air from one side of the blanket to the other, and away from edifice associated objects such as hot embers, e) the blanket edges configured to be pulled at its edges for distributing the blanket over such objects.

Another object is to provide a blanket consisting of aromatic polyamide (aramid) fibers defining a knit yarn, and extended over an edifice, the fibers subjected to stretching to deform, but not eliminate, the vent openings.

A yet further object is to provide local reinforcement edge zones via which deployment pulling force is imposed to displace the blanket to cover the edifice and hang freely; and to provide local pullers at such zones to drag the blanket, a single force gathering puller member typically attached to multiple pullers.

An added object is to provide vent openings that have cross dimensions between 1/64 inch and 1/16 inch, and such openings uniformly distributed over the blanket at between 50 and 150 openings per square inch of fabric sheet dimension.

Another object is to provide a method of resisting fire at an edifice, that includes a) providing and deploying a flexible blanket on or over the edifice, or part thereof, b) the blanket being flame retardant and heat resistant, c) the blanket consisting of aromatic polyamide (aramid) fibers defining a knit yarn fabric, d) the blanket provided to define distributed vent openings of small size to freely pass air from one side of the blanket to the other, and to protect against elongated edifice associated objects such as hot embers, e) the blanket provided to have edges reinforced and configured to be pulled for distributing the blanket over such objects.

These and other objects and advantages of the invention, as well as the details of an illustrative embodiment, will be more fully understood from the following specification and drawings, in which:

DRAWING DESCRIPTION

DETAILED DESCRIPTION

Figure 1:
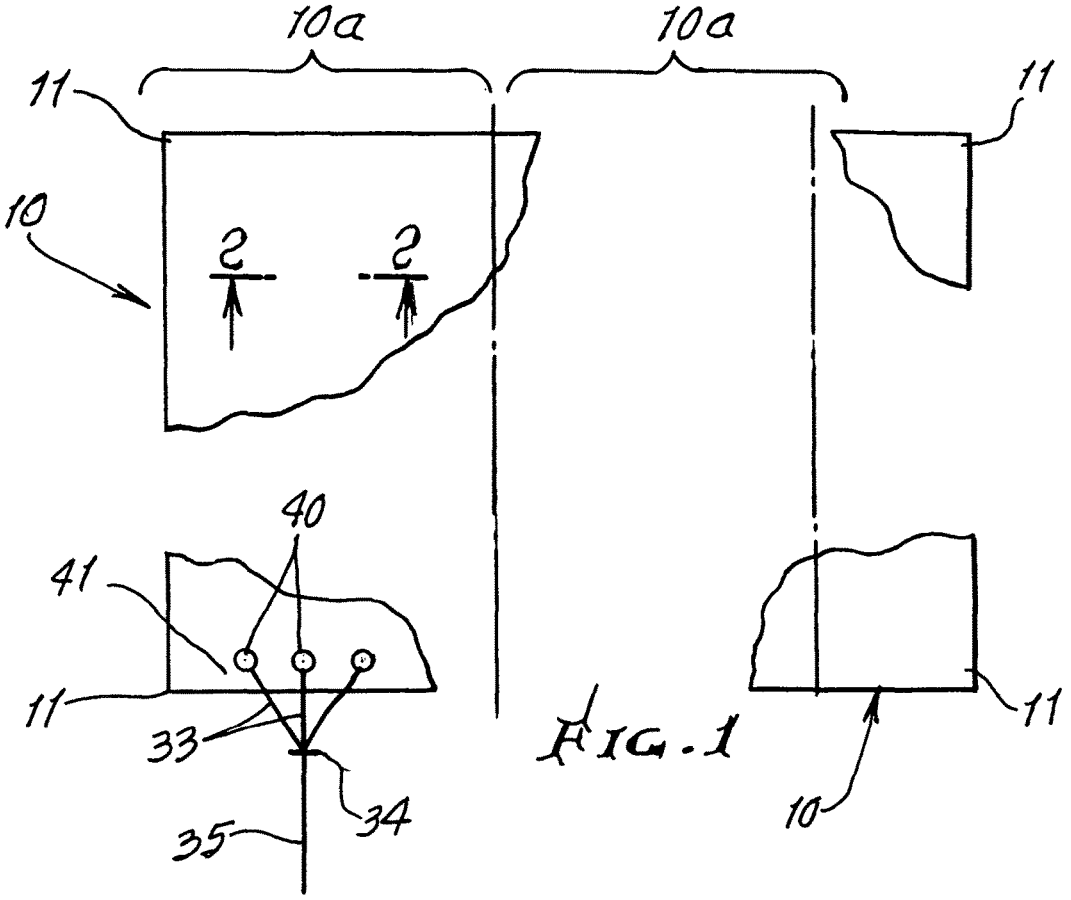
FIG. 1 is a plan view of a large fire resistant blanket embodying the invention.
Figure 3:
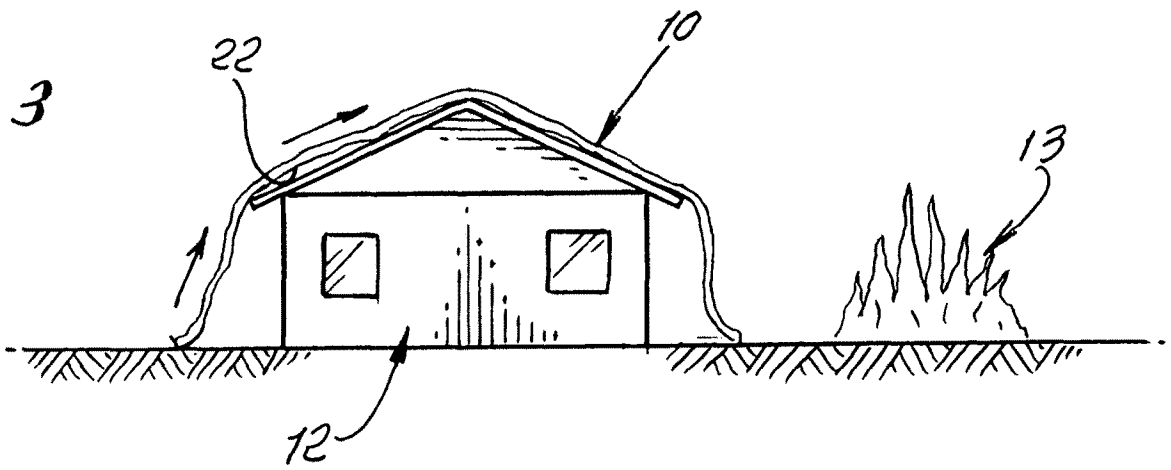
FIG. 3 is an elevation showing blanket deployment over an edifice or large structure to be fire protected, such as a residence or building.

Referring to FIG. 1, a large blanket 10 has corners as at 11, and is typically pulled or deployed over an edifice seen at 12 in FIG. 3, to resist heat and flame. See adjacent or nearby burning material 13. As described, the blanket consists of fire retardant and heat resistant material, preferably aromatic polyamide (aramid) fibers defining a yarn fabric, closely woven or knit. One such material consists of NOMEX, a product of the Dupont Corporation. A typical blanket has thickness between 1/8 inch and 3/8 inch.

Figure 2:
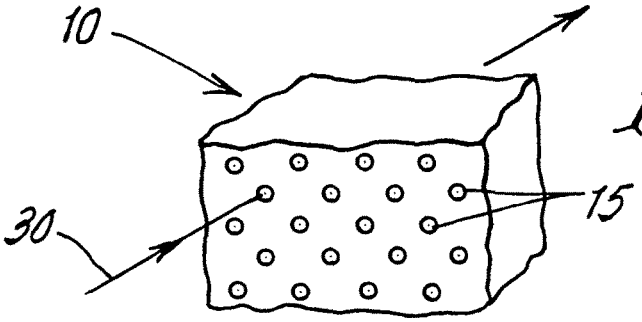
FIG. 2 is a greatly enlarged section of the blanket, taken on lines 2-2 of FIG. 1.

Referring to FIG. 3, the knit fabric defines generally uniformly distributed vent openings 15 of small size to freely pass heated air at 30 from one side of the blanket to the other, as in a direction away from elongated objects such as hot embers outside the edifice, as in space 22. Also, the vent openings are adapted to vent buildings and quench combustion between the hanging blanket and the edifice, to prevent combustion adjacent the building. The vent openings are sized to have cross dimensions between 1/64 and 1/16 inches, and are generally uniformly distributed over and through the blanket area, as at between 50 and 150 openings per square inch of fabric area. Heated air leaving the space 22 between blanket and edifice, reduces tendency for combustion of material in space 22. See FIG. 2.

Also shown are pull zones 40 at the blanket edge regions 41. Such zones may consist of metal rings for attachment of elongated pullers 33 or ropes, that exert force to pull the blanket over the edifice. Multiple such pullers may be joined at 34 to a single puller 35 enabling a person or persons to exert force at locations along the blanket edge, by pulling on one puller 35.

Figure 4:
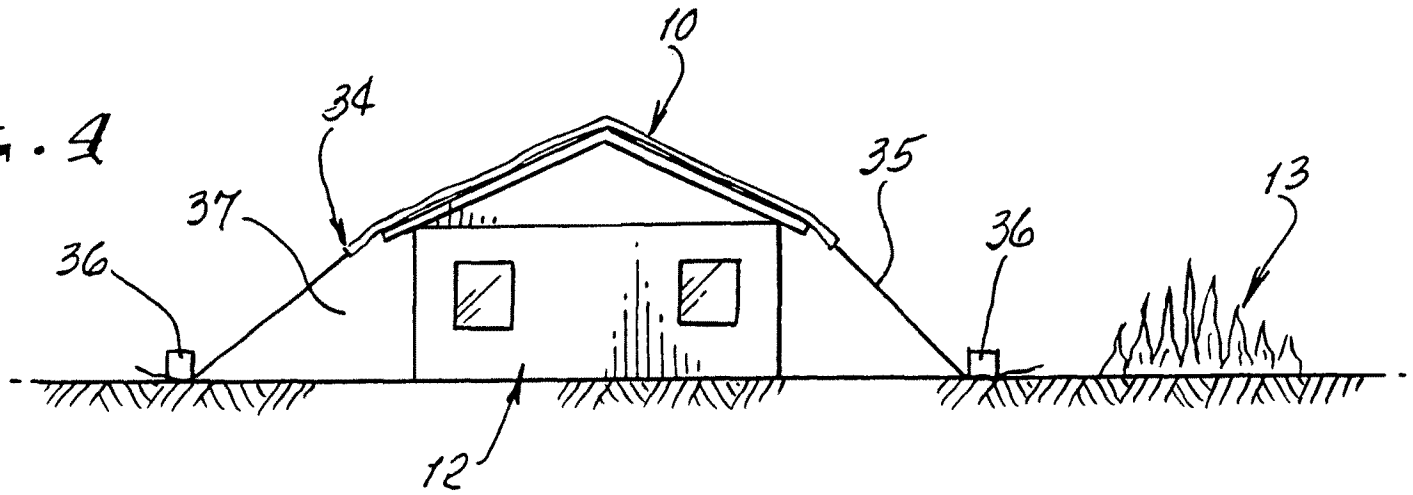
FIG. 4 is like FIG. 3, but showing blanket extensions pulled away from a covered building.

FIG. 1 also shows alternate division of a blanket into sections or strips 10*a* that are easier to deploy lengthwise over the building. Each of the pullers 35 may be deployed away from the building and held in position as by a weight 46. This enables formation of large spaces 37 between the blanket and the building, to enhance cooling in such spaces, for added protection against fire. See FIG. 4.

I claim:

1. A fire resistant system comprising a flexible blanket sized to be deployable on or over an edifice having a top and a side, or a part of the edifice thereof;

wherein the blanket is flame retardant and heat resistant;

wherein the blanket consists of a plurality of aromatic polyamide (aramid) fibers knitted or woven into a fabric;

wherein the blanket fabric has a plurality of vent openings of small size to freely pass air from one side of the blanket fabric to the other;

wherein the plurality of vent openings have a cross dimensions between 1/64 inch and 1/16 inch;

wherein the plurality of vent openings are uniformly distributed over the blanket at between 50 and 150 openings per square inch of the blanket fabric; and wherein the blanket has an edge configured to be pulled for deploying the blanket on or over the edifice.

2. The system of claim 1, wherein the blanket is configuration to extend over the top of the edifice and to hang downwardly at the side of the edifice; and wherein the plurality of vent openings provide visibility through the blanket when the blanket is deployed over the edifice.

3. The system of claim 1, wherein the blanket has at least one reinforcement zone via which pulling force is imposed to deploy the blanket on or over the edifice or a portion thereof.

4. The system of claim 3, wherein the at least one reinforcement zone is located at or proximate to the blanket edge.

5. The system of claim 4, further comprising at least one elongated puller member; wherein the at least one elongated puller member is attached to the at least one reinforcement zone, for deploying the blanket on or over the edifice or a portion thereof.

6. The system of claim 5, further comprising a puller device; wherein the puller device is connected to the at least one elongated puller member; and wherein the puller device is provided near the edge of the blanket.

7. The system of claim 1, wherein the blanket fabric has a thickness between ⅛ inch and ⅜ inch.

8. A method of resisting a fire at an edifice comprising the step of providing and deploying the fire resistant system of claim 1.

9. The method of claim 8, wherein the blanket is deployed to extend over the top of the edifice and to hang downwardly at the side of the edifice; and wherein the plurality of vent openings vent built up heat.

10. The method of claim 8, wherein the blanket has at least one reinforcement zone via which pulling force is imposed to deploy the blanket on or over the edifice or a portion thereof.

11. The method of claim 10, wherein the at least one reinforcement zone is located at or proximate to the blanket edge.

12. The method of claim 11, wherein the system further comprises at least one elongated puller member; wherein the at least one elongated puller member is attached to the at least one reinforcement zone for deploying the blanket on or over the edifice or a portion thereof.

13. The method of claim 12, wherein the system further comprises a puller device; wherein the puller device is connected to the at least one elongated puller member for forcibly pulling the blanket adjacent the edifice.

14. The method of claim 8, wherein the blanket fabric has a thickness between ⅛ and ⅜ inch.

15. The system of claim 1, wherein the plurality of aramid fibers comprises a combination of meta-aramid fibers and para-aramid fibers.

16. The method of claim 8, wherein the deployment of the blanket induces stretching of the fabric and deformation of the plurality of vent openings; and wherein the deformed plurality of vent openings maintain a cross dimension of less than 1/16 inch.

* * * * *